US008820718B2

(12) United States Patent
Weidner

(10) Patent No.: US 8,820,718 B2
(45) Date of Patent: Sep. 2, 2014

(54) WINCH MOUNT FOR ALL-TERRAIN VEHICLE

(76) Inventor: Jamey Weidner, Cambridge Springs, PA (US)

( * ) Notice: Subject to any disclaimer, the term of this patent is extended or adjusted under 35 U.S.C. 154(b) by 0 days.

(21) Appl. No.: 13/614,300

(22) Filed: Sep. 13, 2012

(65) Prior Publication Data

US 2014/0070553 A1 Mar. 13, 2014

(51) Int. Cl.
*B66D 1/00* (2006.01)

(52) U.S. Cl.
USPC ..... 254/332; 254/329; 254/334

(58) Field of Classification Search
USPC ..... 254/323–329, 332, 334
See application file for complete search history.

(56) References Cited

U.S. PATENT DOCUMENTS

| | | | | | |
|---|---|---|---|---|---|
| 4,176,827 | A * | 12/1979 | Anderson et al. | ..... | 254/343 |
| 4,695,010 | A * | 9/1987 | Smith | ..... | 242/478.2 |
| 5,636,648 | A * | 6/1997 | O'Brien et al. | ..... | 134/107 |
| 6,523,806 | B2 * | 2/2003 | Bartal | ..... | 254/323 |
| 6,712,338 | B2 * | 3/2004 | Schafer | ..... | 254/335 |
| 7,080,826 | B2 * | 7/2006 | Pockl et al. | ..... | 254/332 |
| 7,753,345 | B2 * | 7/2010 | Arzberger et al. | ..... | 254/332 |
| 7,770,870 | B1 * | 8/2010 | Fly | ..... | 254/323 |

* cited by examiner

*Primary Examiner* — Emmanuel M Marcelo
*Assistant Examiner* — Angela Caligiuri
(74) *Attorney, Agent, or Firm* — Kenneth C. Spafford

(57) ABSTRACT

A mount for attaching a winch to an all-terrain vehicle. The mount allows the winch to pivot to face the cable anchor during use, thereby preventing improper spooling of the cable. Alternatively, the mount allows the winch to face a predetermined direction during use.

6 Claims, 11 Drawing Sheets

WINCH MOUNT FOR ALL-TERRAIN VEHICLE

FIELD OF THE INVENTION

This disclosure is directed to a device or an assembly that is a winch mount that can be attached to an all-terrain vehicle.

BACKGROUND OF THE INVENTION

All-terrain vehicles ("ATVs") often get stuck in the mud or sand during use and require an external moving force, such as towing or a winch, to become unstuck.

Often an ATV will have a winch attached to the front or back of the ATV. When the ATV becomes stuck, the winch cable is unwound and attached to an anchor, such as a tree or large rock. The winch is then activated to retract the cable, thereby pulling the ATV toward the anchor and out of the mud, sand, or other entrapping surface.

Ideally, the winch will directly face the anchor so that the winch cable will not spool improperly or bind when the winch is retracting the cable. However, anchor position and availability is a matter of luck, and often the best or only available anchor is not directly facing the winch.

It is therefore an object of the present invention to provide various embodiments of an ATV winch mount that allows a mounted winch to pivot towards an anchor, or pivot toward another predetermined direction, during use, thereby allowing the cable to spool properly when the cable is retracted.

DETAILED DESCRIPTION OF THE INVENTION

Figure 2:
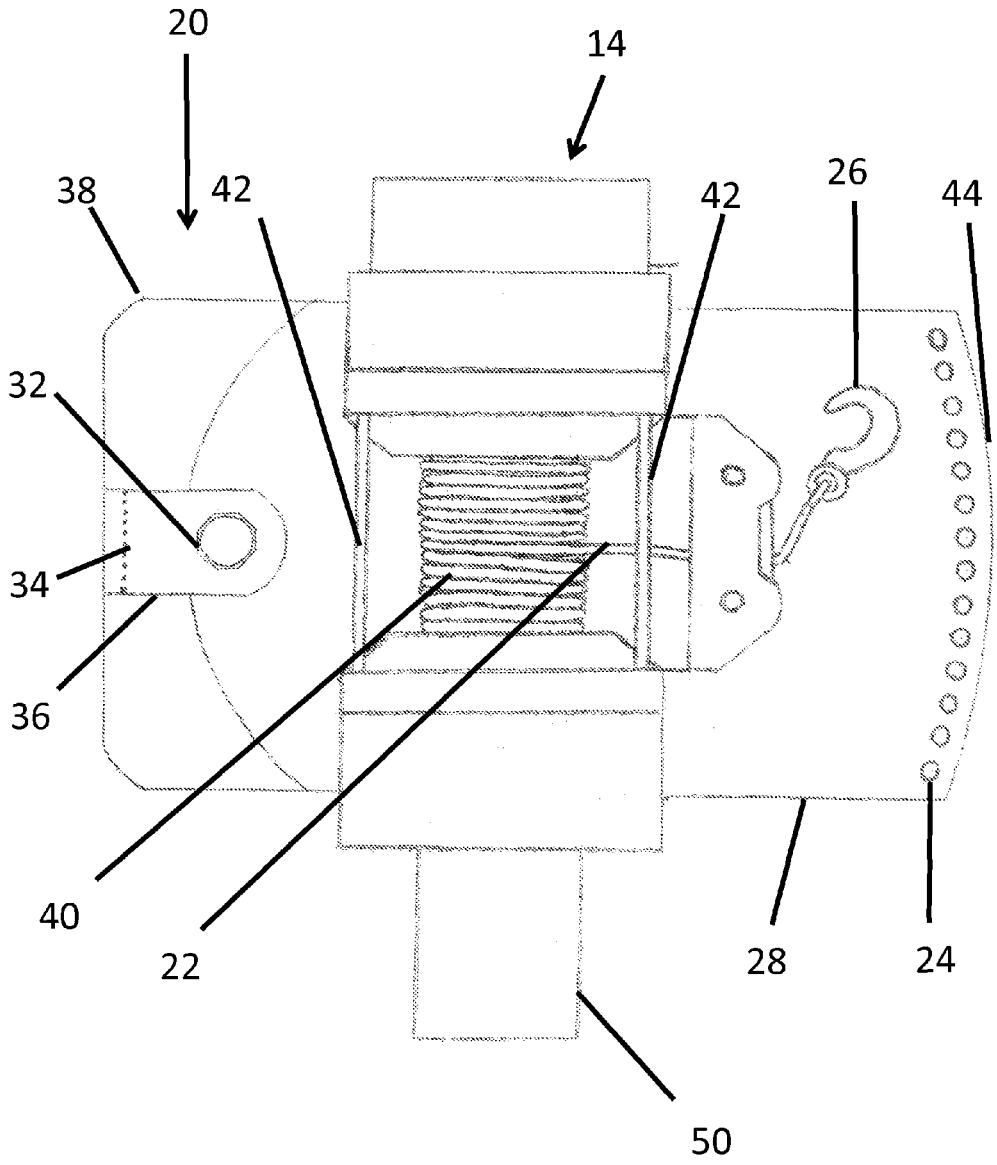
FIG. 2 shows a top view of an embodiment with an attached winch.
Figure 3:
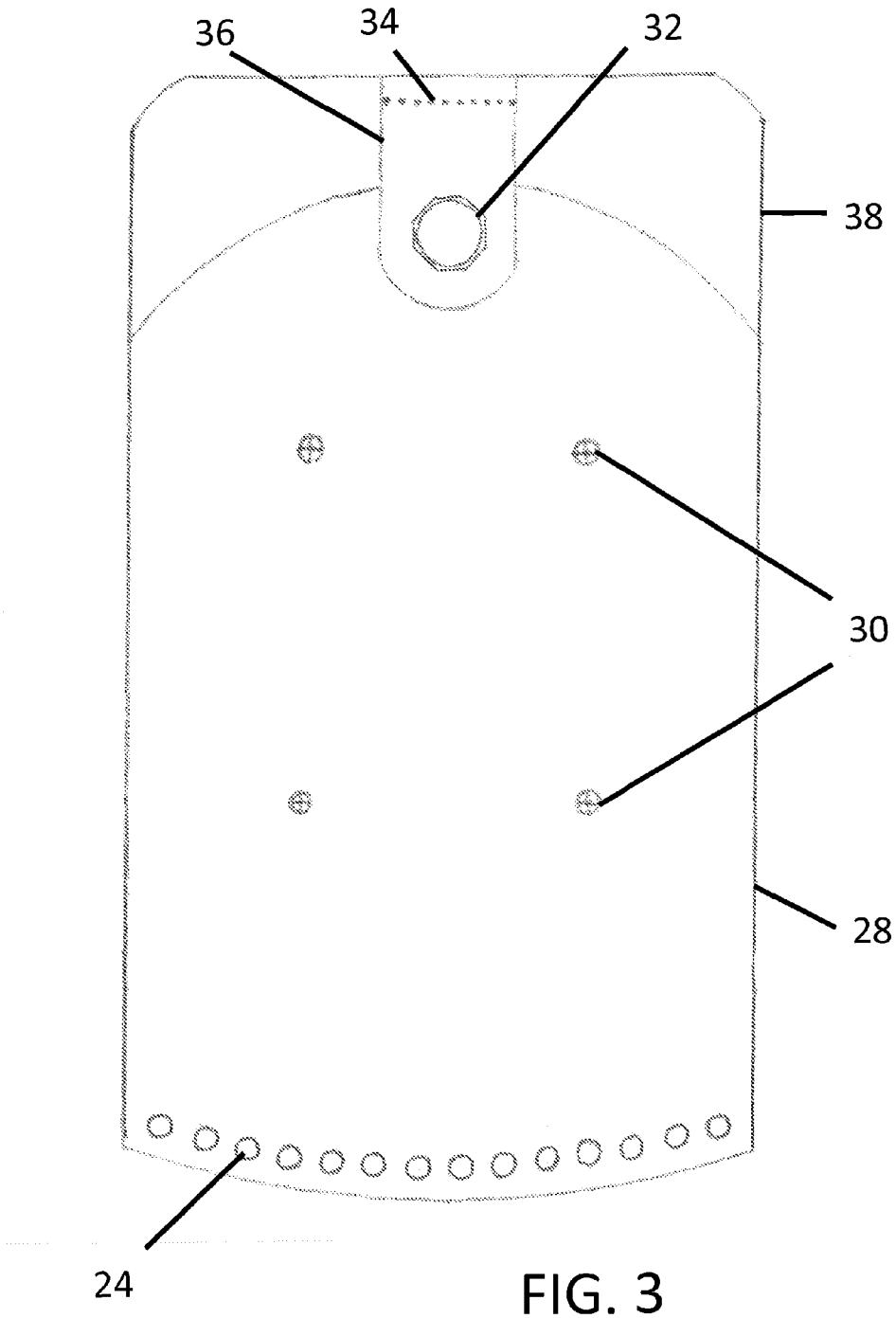
FIG. 3 shows a top view of the embodiment of FIG. 2 without an attached winch.
Figure 4:
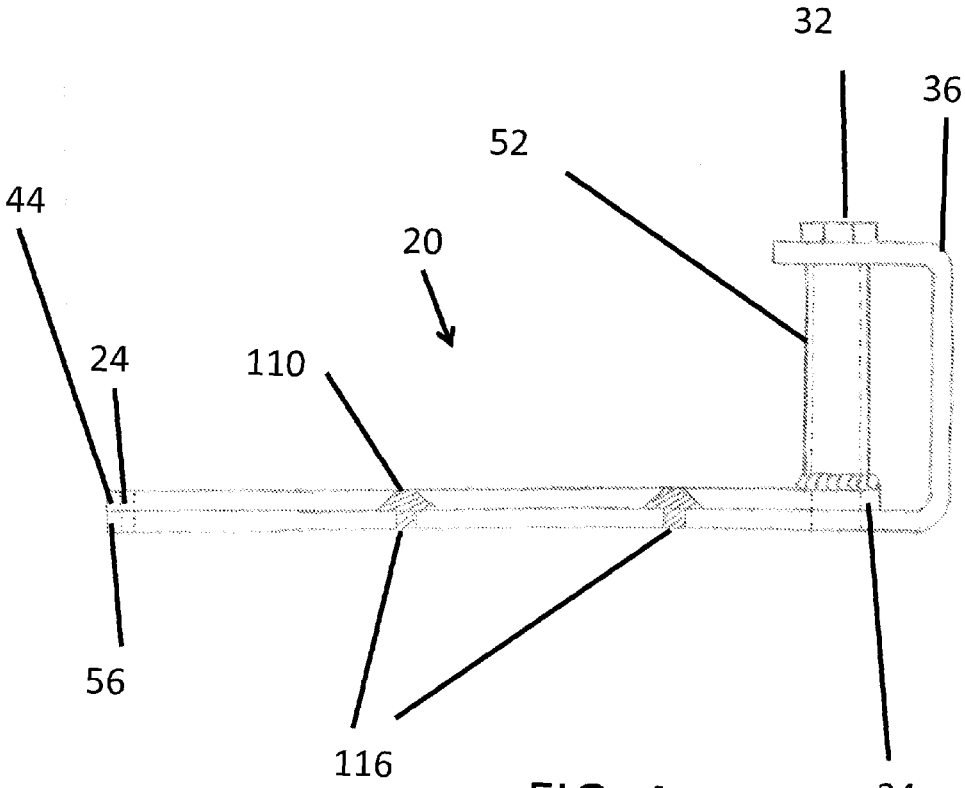
FIG. 4 shows a side view of the embodiment of FIG. 2 without an attached winch.
Figure 5:
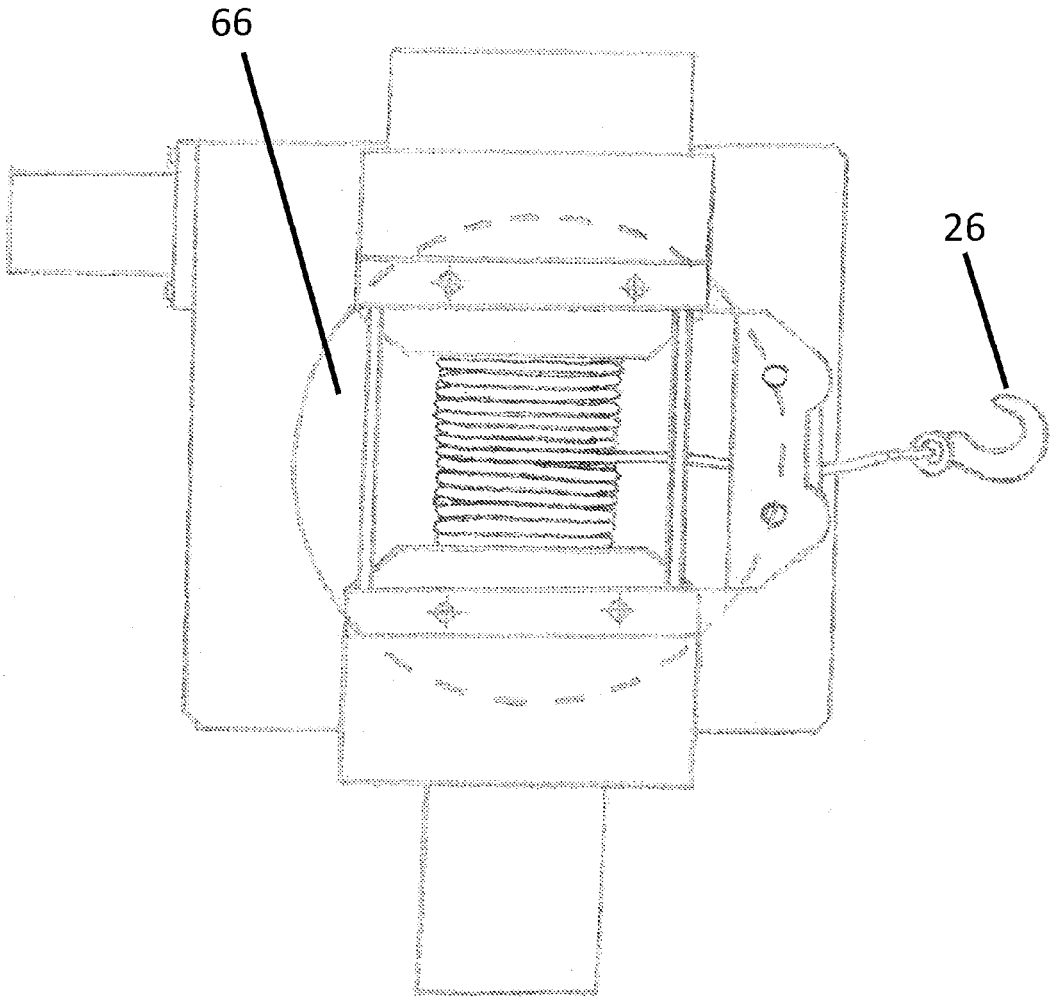
FIG. 5 shows a top view of a second embodiment with an attached winch.
Figure 6:
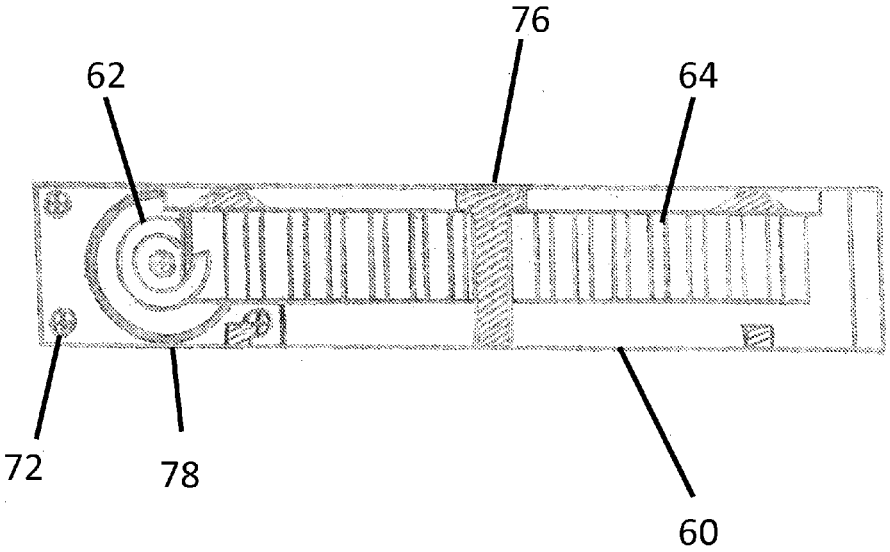
FIG. 6 shows a side view of the embodiment of FIG. 5 without an attached winch.
Figure 7:
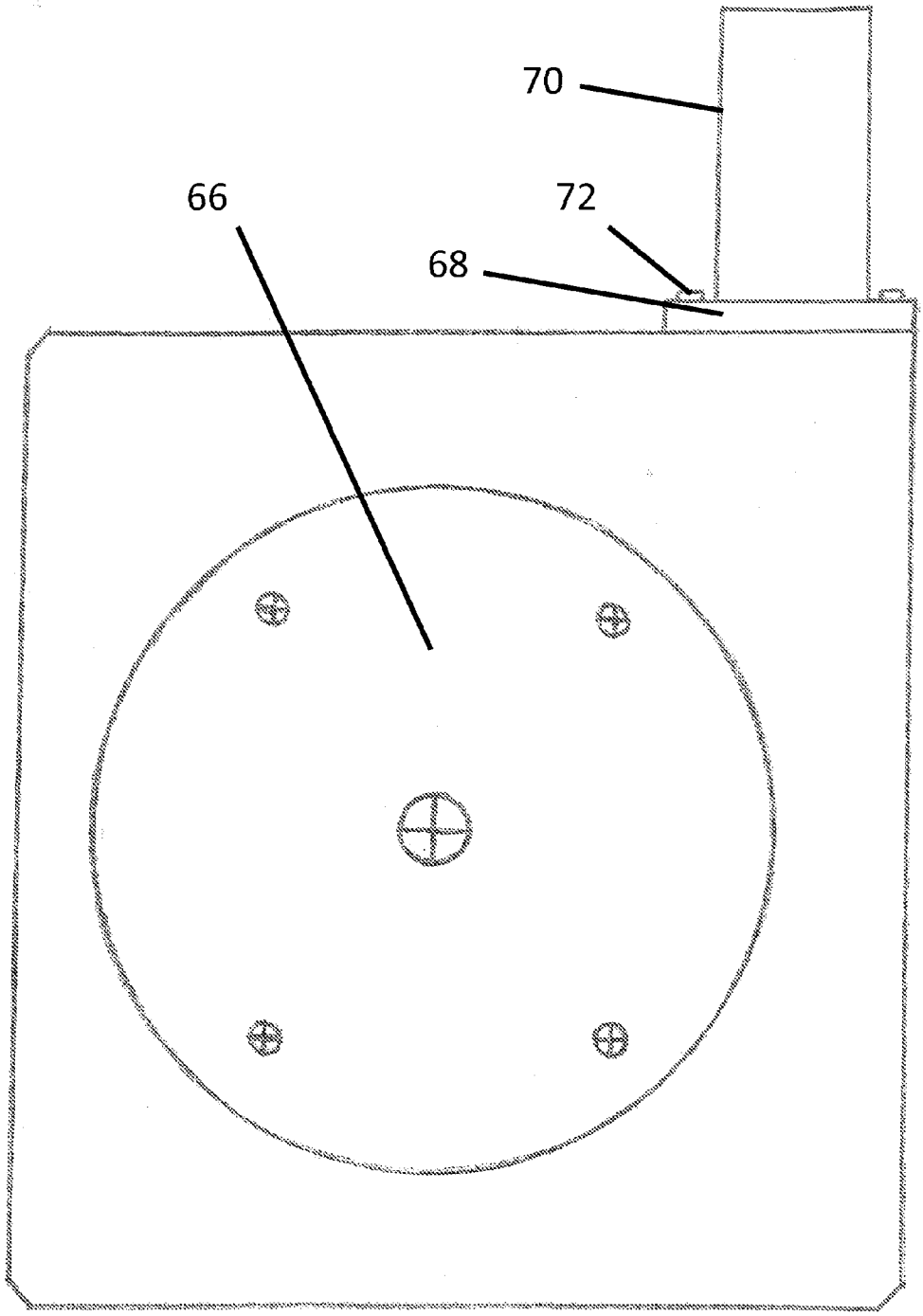
FIG. 7 shows a top view of the embodiment of FIG. 5 without an attached winch.
Figure 8:
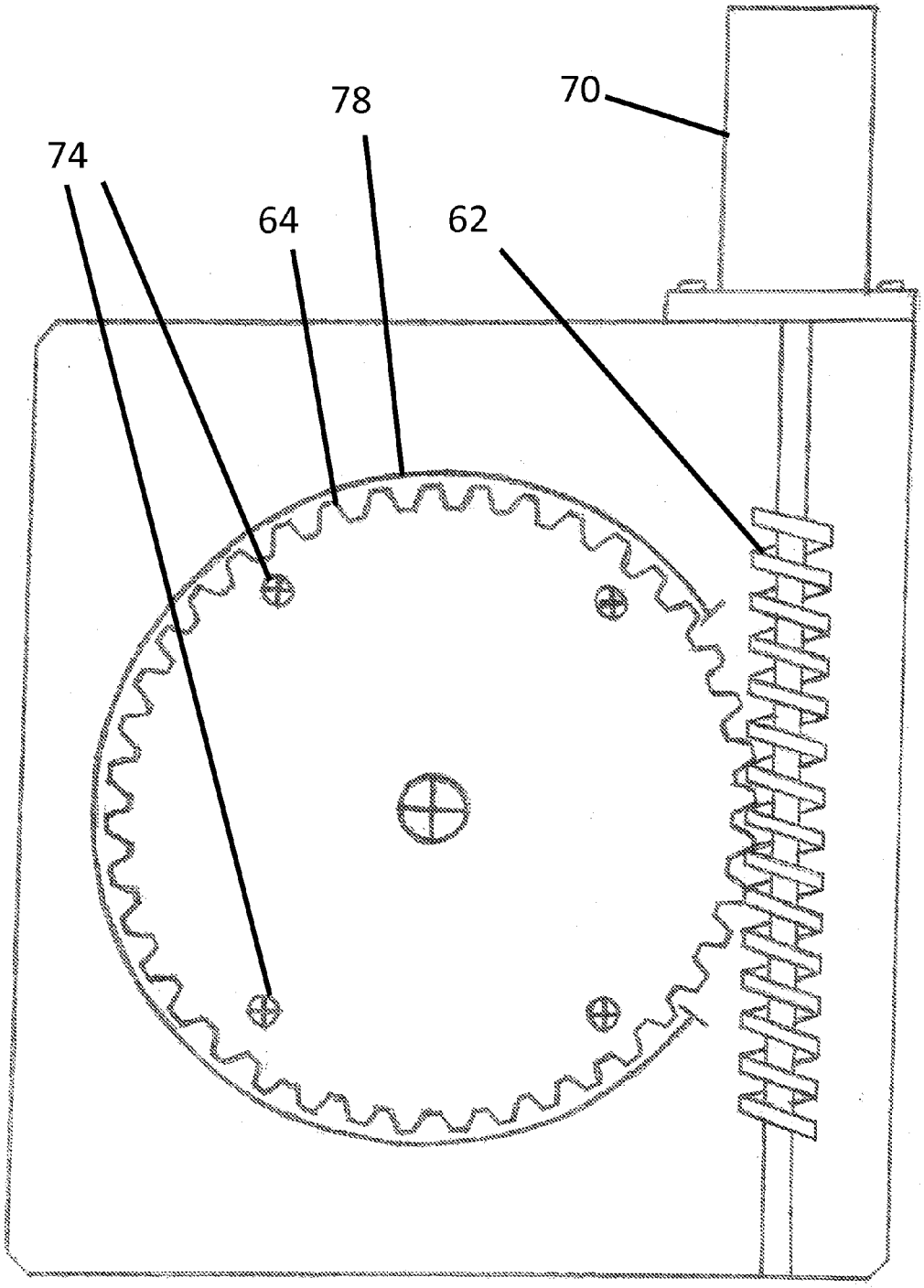
FIG. 8 shows a top cross-section view of the embodiment of FIG. 5 without an attached winch.
Figure 9:
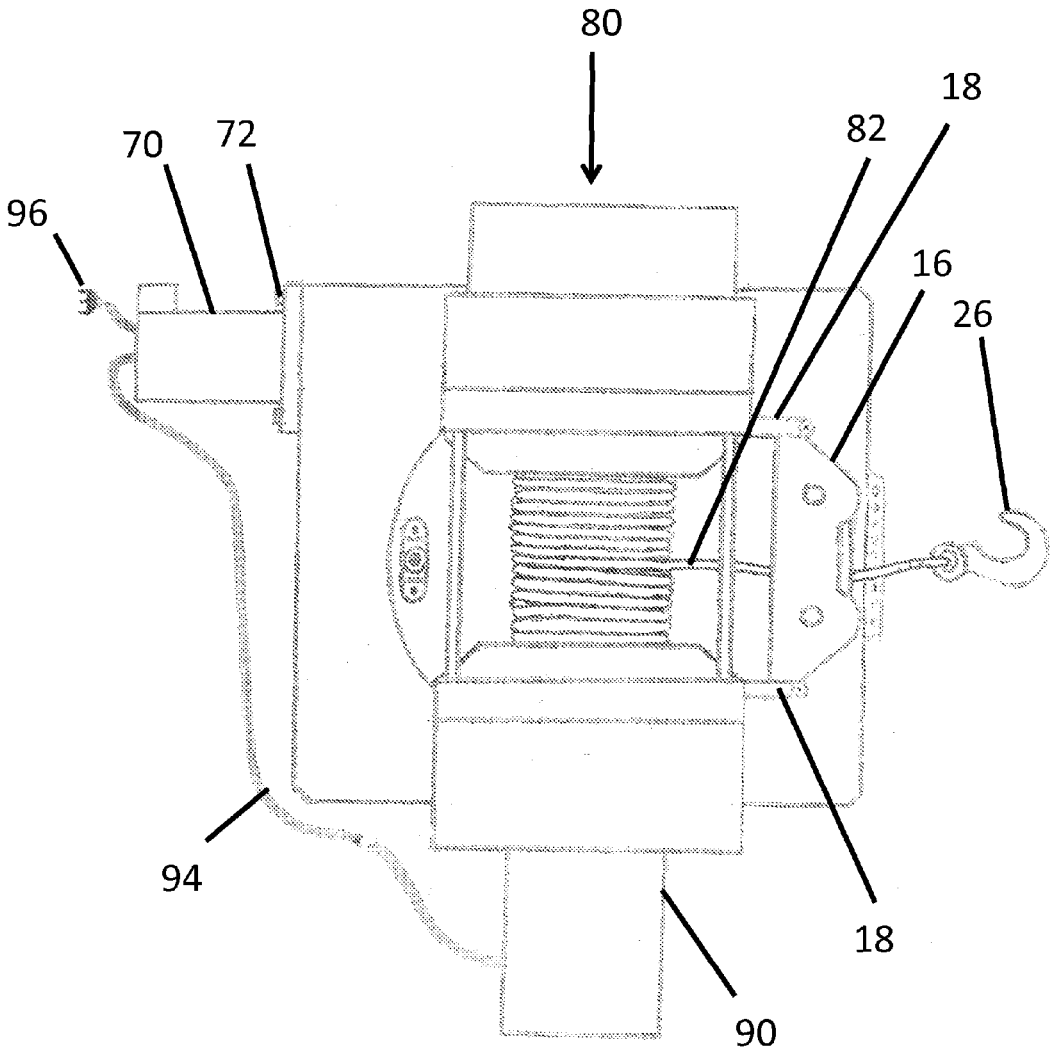
FIG. 9 shows a top view of the embodiment of FIG. 5 with an attached winch and a power connector.

A manual embodiment of the winch mount is shown in FIGS. 2, 3, and 4 generally at 20. Referring to FIG. 2, pivot plate 28 rests flat on base plate 38. Pin holes 24 run directly through base plate 38 and pivot plate 28. Pivot plate front 44 and base plate front 56 are rounded to allow both fronts to remain parallel as pivot plate 28 rotates.

Pivot holding bolt 32 goes through the top of pivot bracket 36, through pivot plate aperture 34, and into the bottom of pivot bracket 36/base plate 38. Pivot holding bolt 32 is covered by pivot tube 52. Pivot bracket 36 may include female threaded apertures where pivot holding bolt 32 intersects with pivot bracket 36 and base plate 38, but pivot plate aperture 34 should not be threaded, in order to allow pivot plate 28 to move freely. Base plate 38 can be affixed to the front or back of an all-terrain vehicle by, for example, allen bolts placed through topped holes 116.

Winch 14, for example a 12-volt DC winch, can include a cable 22, a hook 26, stabilizer bars 42, a winch drum 40, and a motor casing 50. The underside of winch 14 is affixed to pivot plate 28 at countersunk bolt holes 110 with allen bolts 30. Pivot plate 28 may pivot at pivot holding bolt 32, thereby allowing winch 14 to pivot as well. When winch 14 is facing desired direction, a pin (not shown) may be dropped into one of the pin holes 24 at a point where said holes 24 of the pivot plate 28 and base/mount plate 38 are aligned.

Due to the placement of winch 14 in front of pivot holding bolt 32, the natural tendency of pivot plate 28 is to turn toward the pulling force of the cable 22 such that the winch 14 will naturally face the direction of the anchor 10 when cable 22 is being spooled on the winch drum 40.

Figure 1:
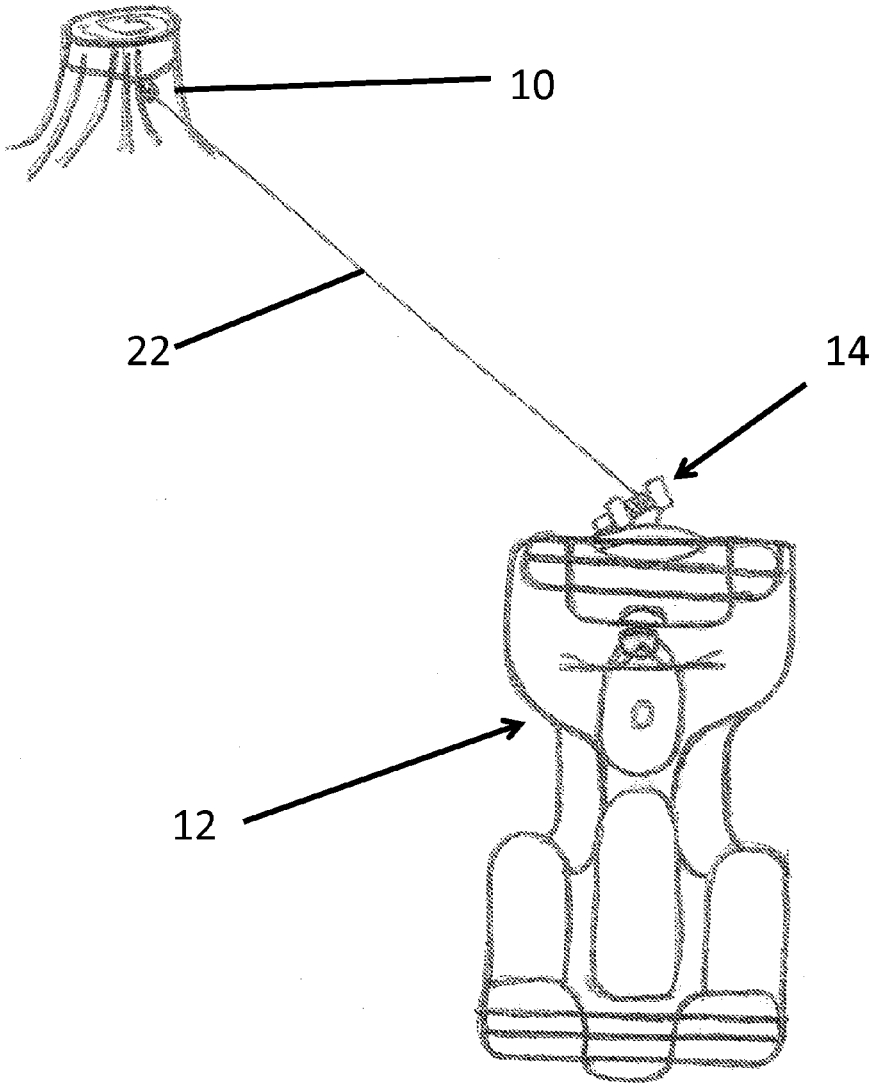
FIG. 1 shows an embodiment of the invention in use.

Thus, as shown in FIG. 1, the winch 14 may directly face an anchor 10, even when the all-terrain vehicle 12 is not directly facing a useful anchor. Thus, the cable 22 is able to spool properly on the winch drum 40 and not bind during retraction of the cable 22.

A motorized embodiment and its subparts thereof are shown in FIGS. 4-9. In this embodiment, pivot plate 66 and toothed wheel 64 are located in recess 78 in winch mount base 60. Pivot plate 66 is affixed to toothed wheel 64, by, for example, threaded apertures with allen bolts 74. Pivot plate 66 covers toothed wheel 64 completely in order to prevent foreign objects from being lodged in toothed wheel 64. Center pivot bolt 76 is threaded when contacting winch mount base 60 but is not threaded where contacting pivot plate 66 or toothed wheel 64. Worm cylinder 62 is located in hollow cylinder 78 inside winch mount base 60. Worm cylinder 62 interlocks with toothed wheel 64 such that toothed wheel 64 will rotate when worm cylinder 62 spins.

Worm gear motor casing 70 is affixed to winch mount base 60 at flange 68 with fasteners 72, for example, allen bolts. The worm gear motor (not shown), which resides in worm gear motor casing 70, is affixed to worm cylinder 62. Worm gear motor (not shown) can be, for example, a standard 12-volt DC motor and is well known to those with ordinary skill in the art.

Winch 80 is affixed to pivot plate 66 with, for example, allen bolts 74, thereby allowing winch 80 to rotate when worm gear motor is activated. If needed, winch 80 can rotate 360 degrees.

At least two wires inside power/signal cord 94 are electrically coupled to winch drum motor (not shown), for example a 12-volt DC motor, located in winch drum motor casing 90. At least two additional wires in power/signal cord 94 are electrically coupled to worm gear motor (not shown). Power/signal cord coupler 96 is attached to, for example, the battery for the all-terrain vehicle, as well as to a controller that can send current to the worm gear motor or to the winch drum motor. These types of battery and controller electrical couplings are common for winches installed on all-terrain vehicles and are well-known and can be easily duplicated by those with ordinary skill in the art. Power/signal cord 94 is long enough to allow winch 80 to rotate without pulling power/signal cord 94 taut.

Modifications to the invention and embodiments described above are numerous and the means of their implementation will be obvious to those skilled in the art. By way of example only, the winch may include a fairlead 16 with trigger 110 switches on each fairlead side 18 that will cause the winch position to self-correct when the cable 82 pushes against one of the trigger switches. The trigger switches would be electrically coupled to the worm gear motor such that the worm gear motor will activate in a certain direction when the cable 82 presses against and activates one of the switches, thereby rotating the winch to a centered position during unspooling or spooling of the cable.

As another modification example, the controller for the worm gear motor may be controlled by a smart phone application, or by a coded remote control device.

As another modification example, the worm cylinder 62 may include an externally accessible coupling for an allen key or other turning mechanism, such that worm cylinder 62 (and therefore pivot plate 66) may be turned manually if needed.

As another modification example, the winch mount base 60 can include LED lights that are electrically coupled to the power/signal cord 94, for nighttime visibility and use.

As another modification example, a camera may be attached to the winch 80 such that a user could, for example, view through a smartphone application the progress of the spooling of the cable 82, to determine, for example, whether the cable was at risk of unspooling completely or, for example, whether the cable was spooling properly, thereby allowing a user to keep a safe distance from the winch and taut cable while the winch was in use.

Figure 10:
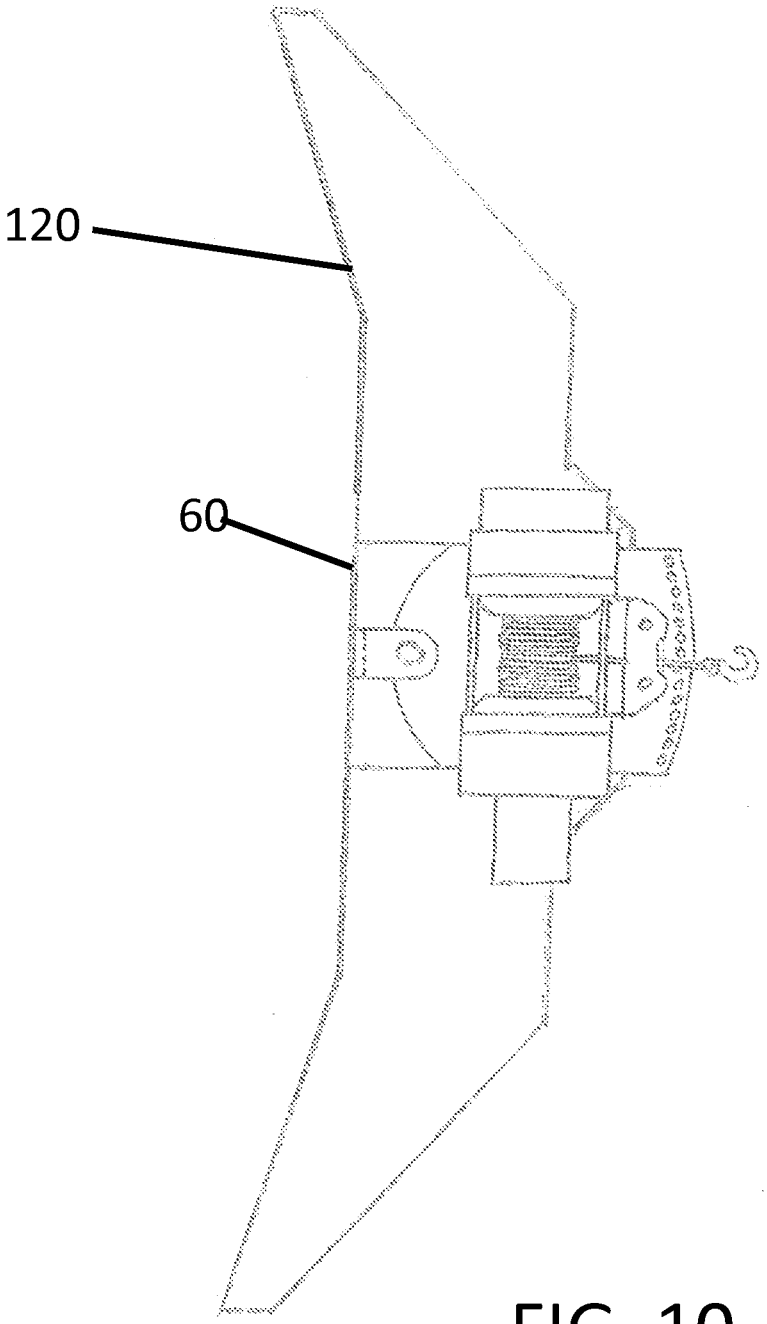
FIG. 10 shows a top view of the embodiment of FIG. 5 with a bumper cover and a winch.
Figure 11:
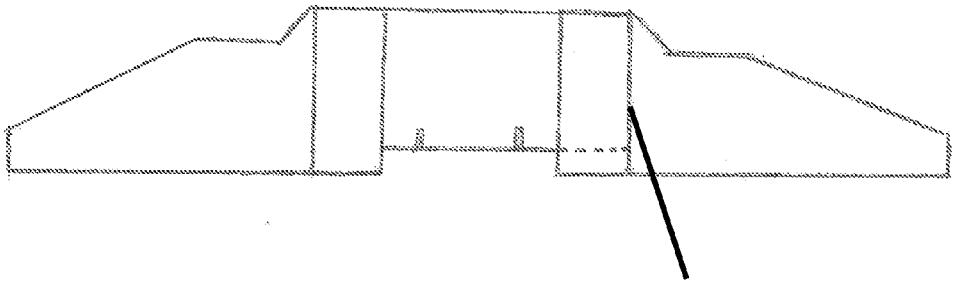
FIG. 11 shows the bumper cover of FIG. 10 without the winch.
Figure 12:
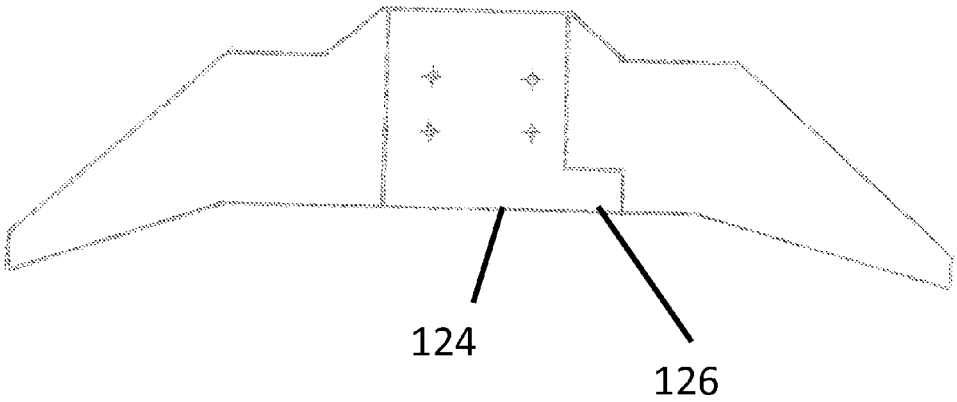
FIG. 12 shows a top cross-section view of the bumper cover of FIG. 10.

As another modification, as shown in FIGS. 10-12, the winch mount base 60 may attach to a larger bumper cover 120 at the bumper mount base 124. Side flap 122 covers worm gear motor casing 70 and any power/signal cord coupler 96 at 135 bumper mount base portion 126.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. A winch mount, comprising:

a base, wherein said base includes a top and a bottom, and wherein said base is substantially solid and substantially comprised of metal, and wherein said base includes (a) a recess at the top of said base, and (b) a base plate;

a pivot plate, wherein said pivot plate is substantially solid and is located at least partially within said recess, and wherein said pivot plate is disc-shaped;

a toothed wheel;

wherein said pivot plate is parallel to said base plate;

wherein said pivot plate includes at least one vertical bolt hole;

a motor, where said motor is operable to move said toothed wheel;

wherein said pivot plate is affixed to and parallel to said toothed wheel;

wherein said base includes at least one lower bolt hole;

an electric cable, wherein said cable is electrically coupled to said motor;

wherein said electric cable is operable to electrically couple to a winch;

wherein said electric cable includes a mechanism to electrically couple said electric cable to a power source; and a control, wherein said control is electrically coupled to said cable, and wherein said control is operable to control the power and current direction through said cable from said power source to the winch and said motor.

2. The winch mount of claim 1, wherein said toothed wheel is a worm gear, and wherein said winch mount further includes a worm cylinder coupled with said worm gear.

3. The winch mount of claim 2, wherein said worm gear includes an externally accessible coupling for an alien key.

4. The winch mount of claim 1, further comprising a center pivot bolt, wherein a first portion of said center pivot bolt is located in the center of said pivot plate, and wherein a second portion of said center pivot bolt is located in the center of said base plate, and wherein a third portion of said center pivot bolt is located in the center of said toothed wheel, and wherein said pivot bolt is in a fixed position relative to said base.

5. The winch mount of claim 1, wherein said toothed wheel and said pivot plate are in superposition.

6. The winch mount of claim 1, wherein said toothed wheel is affixed to said pivot plate with alien bolts.

* * * * *